United States Patent [19]

Traise

[11] 3,955,737

[45] May 11, 1976

[54] WEB FEED APPARATUS

[75] Inventor: John E. Traise, Lewiston, N.Y.

[73] Assignee: Moore Business Forms, Inc., Niagara Falls, N.Y.

[22] Filed: July 23, 1975

[21] Appl. No.: 598,288

Related U.S. Application Data

[63] Continuation of Ser. No. 459,175, April 8, 1974.

[52] U.S. Cl. ..... 226/108; 226/195

[51] Int. Cl.[2] ..... B65H 17/20; B65H 17/24

[58] Field of Search ..... 226/113, 114, 108, 111, 226/117, 195; 242/75.2

[56] References Cited

UNITED STATES PATENTS

| | | | |
|---|---|---|---|
| 3,727,820 | 4/1973 | Braun | 226/113 |
| 3,764,050 | 10/1973 | Clark | 226/111 X |

*Primary Examiner*—Richard A. Schacher

*Attorney, Agent, or Firm*—Watson, Cole, Grindle & Watson

[57] ABSTRACT

A web feed apparatus wherein a section of the web is maintained at a higher tension while accurately metering the feed of the web at a relatively lower tension, means being provided to isolate the low tension metering function from the higher tension section by anterior snubbing rolls and posterior tension pull-up rolls. A typical mechanism is a blanket offset business forms printing press which must satisfy the requirement of very accurate web feed rate over a given length of the web, when the blanket-impression nip at the print couple(s) with the attendant higher tension requirement to maintain print quality and web lay, are both necessary.

6 Claims, 4 Drawing Figures

WEB OUT 25
27
26
16
S3
F5
28
29
S4
F6
10
F7
F8
S1
32
S2
21
24
F3
23
22
19
18
F1
1A
17
14
15
11
12
13
13'
20
17'
14'

WEB FEED APPARATUS

This is a continuation of application Ser. No. 459,175 filed April 8, 1974.

This invention relates generally to web fed machinery which must utilize sufficiently high web tension to maintain control of the web where, in addition, the web must be accurately fed and registered into the machine by synchronous punching, pre-printing or other precise non-error-accumulative metering means.

For purposes of consideration, the invention is described in relation to a rotary web fed business forms press which delivers a continous processed web, with the printing or any other applied indicia on the web such as marginal punching, perforating or other related synchronized operations, being mutually registered to each other.

In a conventional rotary web fed press, more particularly a press used for the manufacture of printed matter with timed indicia, such as marginally punched business form stationery, line hole punching and printing take place simultaneously as the web processes through the press.

Both printing and punching are accomplished while the web is under relatively higher tension, and various means of controlling tension and sheet length of a given length of web infeed have been applied with varying degrees of success.

One problem encountered with such a system is that a rotary web press, with a multiplicity of print couples and feed cylinders, and the attendant mechanical coupling of them through gearing or belting, creates differential web tension and elastic elongation of the web, anterior and posterior to each couple, or cylinder, which can be of sufficient magnitude to slip the web on the print couple or feed cylinder when the differential tension and/or elongation exceeds the physical holding strength around the feeding cylinder of any couple, as governed by the capstan wrap of it. This random re-alignment of tension and web lay results in a corresponding positional re-alignment of the web which can result in a color-to-color registration shift, punch-to-print error, or in a non-accumulative error in the hole-to-hole spacing of the marginal punching, more commonly known as "punch hop."

Another difficulty is that the cumulative tension through a press can be so high that the web processing through can overpower the accurate metering of the web, resulting in slippage on the metering cylinder which will result in a cumulative error over a given length of processed web. This error, if excessive, can cause difficulty in the collation of several individually processed webs, typical of continuous business form manifolds, and in the successive operation over computer printers or other processing equipment.

A further difficulty is that the web metering means affects sheet length compensation according to web caliper and tension, and that the unavoidable variations in web tension which occur in the press reflect in varying degree to the tension on the metering unit, and therefore to the sheet length accuracy which it is capable of maintaining.

It is the general objective of this invention to provide an arrangement, in a rotary web fed press, which permits low-tension metering of the infeed web by means of marginal punching fed through conventional form feed tractors, or by a conventional metering drum, as an integral part of the press, so as to meter the web through the print couple(s) while at the same time permitting a relatively high web tension at the print couple(s) with minimum blanket gap and without allowing the high tension section of the web to be transmitted back to the marginal punching, metering drum or synchronization means, where errors described above could affect sheet length accuracy.

Another objective of this invention is to provide such a press or apparatus, wherein the web entering the press or apparatus is synchronized to the print couple(s) or other operation thereat by previously designated synchronization means for registration and re-registration.

Another objective of this invention is to provide a press wherein a control system is provided ahead of the print couple(s) or other operation in the higher-tension section, to isolate the higher-web tension necessary and desirable at the print couple(s) or other operations, from the relatively low tension control capability of the multiplicity of marginal feed pins or other synchronous timing means on the web.

A further objective of the present invention is to provide such a press or apparatus, wherein any practical number of web operations as, for example, printing operations, may take place successively with each being timed to the advancing web, wherein each higher tension section may be alternately established and relaxed in a similar manner as set forth above, to eliminate the accumulation of tension buildup and the increasing difficult problem of tension escapement at any individual print couple or feed cylinder.

Other objects, advantages and novel features of the invention will become more apparent from the following detailed description of the invention when considered in conjunction with the accompanying drawings wherein.

As mentioned above, the present description is generally illustrative of an offset print couple in conjunction with a tractor-fed marginally punched web. It will be apparent to those skilled in the art, however, that alternate operational units in place of, or in addition to, the blanket print unit, as well as alternate means of web metering and synchronization within the scope of the invention, are without violating the spirit of it.

Figures 1, 1A:
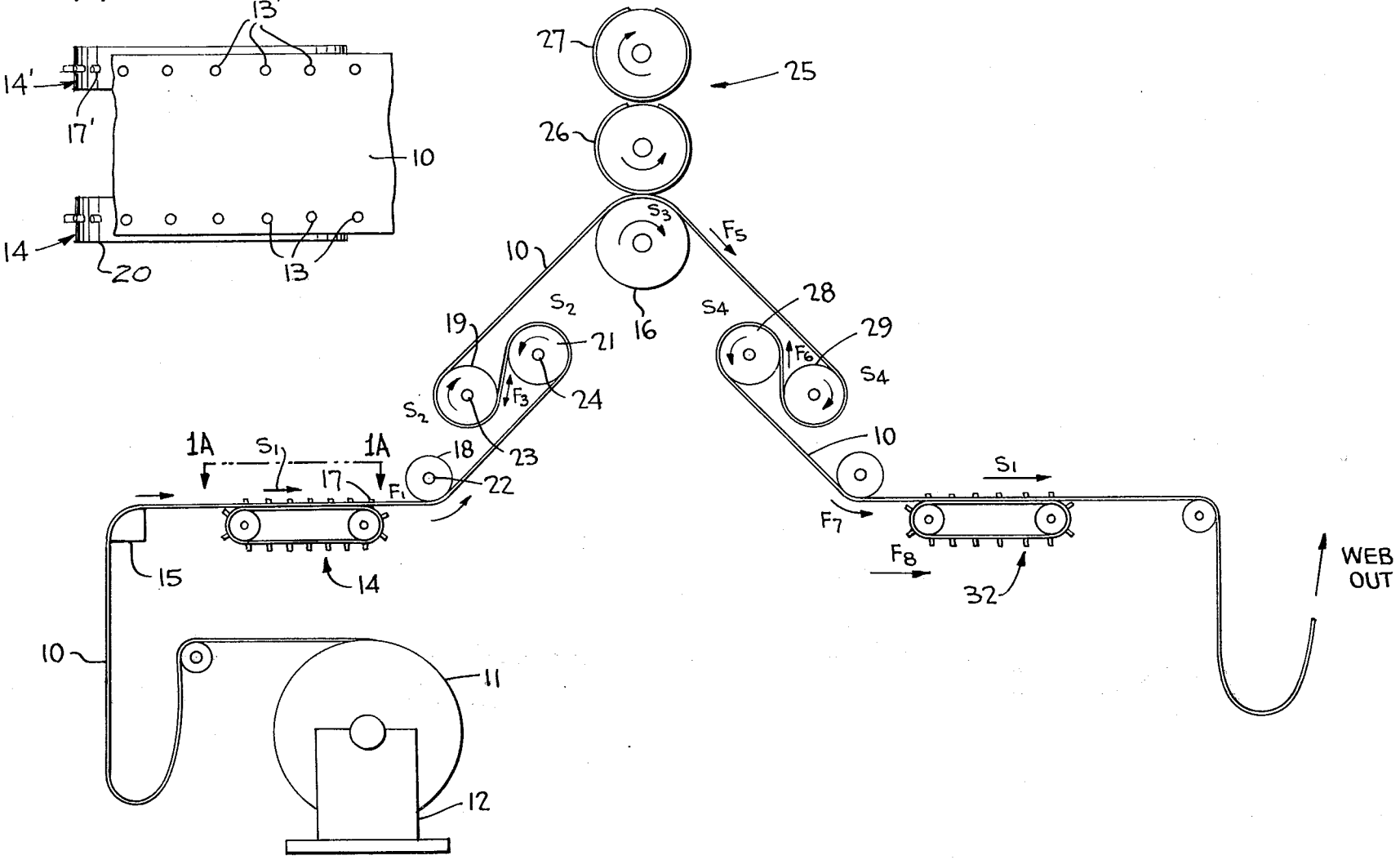
FIG. 1 is a schematic illustration of a rotary web fed press incorporating the present invention.
FIG. 1A is a plan view of the web taken in the direction of line 1A—1A of FIG. 1.

Referring to FIG. 1, a continuous web 10 to be printed or otherwise worked on is drawn by conventional methods from a supply roll 11 rotatably mounted on an upstanding bucket 12. In this embodiment of the invention, web 10 may be pre-punched along one edge with regularly spaced punching 13, or along both edges with rows of parallel punching 13 and 13' as shown in FIG. 1A. The web 10 so punched enters feed tractors 14 and/or 14', these tractors being designated as the primary means of registration control, as determined by a conventional timing belt coupling (generally designated 15) through a pulley and belt system driven from a cooperating impression cylinder roll 16, with a ratio predetermined to provide the metering of paper via tractor pins 17 located on an endless tractor belt 20 of feed tractor 14 nominally at the same surface advance as the surface displacement of impression cylinder 16. Pins 17 are spaced identical to the spacing of feed holes 13 or 13' along the margins of web 10 in the customary manner.

The web is further led over snubbing rolls 18, 19 and 21, each mounted for rotation on corresponding parallel axes 22, 23 and 24, and cooperatively gear driven by impression cylinder 16 and the snubbing rolls, at a ratio to be hereinafter described.

The web is further led around impression cylinder 16 of the print couple generally designated 25. The print couple is shown in FIG. 1 as including the aforementioned impression cylinder 16, a blanketed cylinder 26 and a plate cylinder 27. For clarity, other rolls and press components including the associated ink train mechanism are not shown. In this embodiment, web 10 is further led from the impression cylinder through a set of pull-up rolls 28, 29 and 31 symmetrically disposed with respect to snubbing rolls 18, 19 and 21 posterior to the print couple. Web 18 is then further led to an exit tractor 32 and/or 32' (not shown) which are symmetrically disposed with respect to the infeeding tractor 14 and/or 14'.

In accordance with the aforedescribed arrangement, the relatively high web tension at the print couple (necessary and desirable in rotary press printing operations) is isolated from the low web tension permitted by the combined hole strength holding force available at the tractor feed units. This isolation is accomplished by the action of the capstan-type snubbing roll system 18, 19 and 21 located between infeed tractor 14 and the infeed to the impression cylinder, and by the corresponding isolation by the action of the capstan-type pull-up rolls 28, 29 and 31 located between the exit of the impression cylinder and exit tractor 32.

The metering of paper to the press by marginal punching where full blanket printing is used, has presented extreme feeding difficulties due to the imperfect balance of cylinder diameters and paper caliper variation which changes the true feeding pitch diameter around a cylinder. This is further complicated by blanket construction, ink tack, and web tension. Relatively high web tension following the blanket print couple is desirable to eliminate the effects of the ink tack, while tension generally is desirable to improve paper lay through the press mechanism. This tension is far in excess of the available holding strength of the plurality of marginally punched holes available on standard paper feeding tractors, as is the couple holding strength between cylinders 16 and 26. This problem is overcome with the use of the capstan snubber system comprised of rolls 18, 19 and 20, and the pull-up system comprised of rolls 28, 29 and 31.

The force consideration and paper travel consideration will hereinafter be described with reference to FIG. 1 wherein the S notations represent surface paper feed and F represents force or tension on the web. Snubbing rolls 18, 19 and 21 are sized to rotate at such a rate as to slightly underfeed the web from feed tractor 14. (The means to effect this underfeed are not shown in the drawings in the interest of clarity.) For stability and tension control, the surface feed $S_3$ at the impression cylinder-to-blanket cylinder nip should not be less than the surface feed $S_1$ at the tractors 14 or 32, as sized for the thinnest web necessary to print. Accordingly, the web tension successively must build incrementally to $F_4$ from infeed tension $F_1$ at the exit of tractor pins 17, and decrease incrementally from $F_5$ at the exit of the impression cylinder to $F_8$ at the entrance to the exit tractor. At the infeed side this is accomplished by the action of snubbing rolls 18, 19 and 21, which have a surface feed $S_2$, which is less than surface feed $S_1$ or $S_3$. Actually, rolls 18, 19 and 21 can be driven at any surface feed under $S_1$ or $S_3$, or can even be made stationary. However, due to the possibility of wet ink offset from previous operations it is desirable to match the one-revolution advance of the snubbing rolls to some multiple of form depth, and the actual percentage of slip should be kept small to eliminate excessive kinetic heating by action of friction slip which increases with speed.

The exit control or pull-up rolls, which overfeed the web by appropriate means (not shown) at a roll surface feed $S_4$, serve just the opposite effect as the snubbing rolls on the infeed side, with $S_4$ being greater than any other feed. The same slip, offset and tension release conditions apply in reverse, and tension from $F_5$ back down to exit tension $F_8$ is accomplished in this arrangement.

In operation, the effect of the snubbing rolls, individually or collectively, is to isolate the high web tension from the low web tension in accordance with the basic capstan equation $F_{out}/F_{in} = e^{f\theta}$ , where f is the apparent coefficient of friction between the web and the snubbing rolls (capstan surface), and $\theta$ is the total angle of capstan wrap in radians. Accordingly, the $F_{out}/F_{in}$ ratio is the resultant mechanical advantage or isolation through the roll system. The arrangement shown schematically in FIG. 1 is similar to one actually employed which has provided an effective isolation, or force multiplication, between $F_1$ and $F_4$ of about 32. Translated into the practical strength limitations of a plurality of pin-restrained margin punching holes, this means that 16 pins, with a combined holding force $F_1$ of about 4 lbs., would permit web tension at $F_4$ of about 128 lbs. before the paper is pulled from tractor pins 17.

With the aforedescribed printing press arrangement, a highly accurate registration may be maintained between the punched holes of the web and the succession of impressions printed on the web. The web may be readily subjected to overprinting, numbering, folding, perforating, and/or other finishing operations with accurate register achieved by engagement by appropriate tractor or sprocket means in the finishing apparatus with the punched holes of the web.

It is also apparent that the print couple 25 shown schematically could be any basic printing technique, or could be used with equal facility for any other mechanical operation where such operation must be performed synchronously with other indicia on the web.

Figure 2:
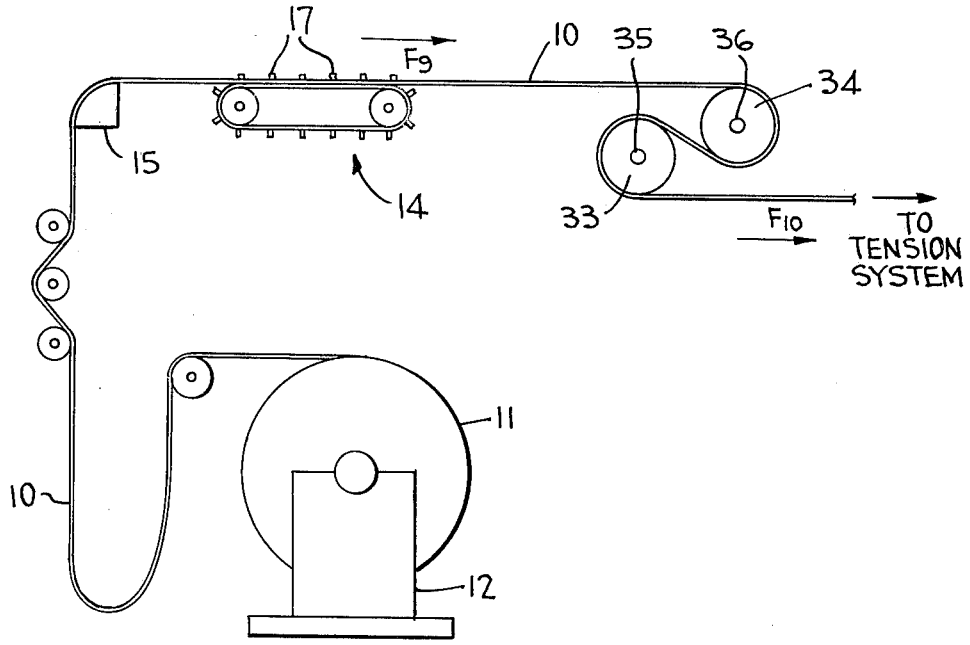
FIG. 2 is a schematic illustration of the invention adaptable for a web tension system.

Moreover, isolation of the aforedescribed high web tension from the low web tension at the infeed is effective for operations requiring high web tension for operations other than those requiring accurate register between the punched holes of the web and operations including the succession of printed impressions, numbering, or folding, etc., which take place at the print couple. For example, the high web tension is normally required for rewinding the web onto a web rewind unit. FIG. 2 schematically illustrates the manner in which the high web tension at $F_{10}$ is isolated from the low web tension at $F_9$ at the exit of tractor pins 17. The arrangement according to FIG. 2 is similar to that of FIG. 1 except that the web is fed directly to a web rewind unit (not shown but indicated to "To Tension System")

rather than around an impression cylinder such as that provided at print couple 25. $F_{10}$ is therefore analogous to $F_4$ of FIG. 1.

The web in FIG. 2 is fed over snubbing rolls 33 and 34 which correspond to rolls 19 and 21 of FIG. 1. These snubbing rolls, of course, are mounted for rotation on corresponding parallel axes 35 and 36, and are cooperatively gear-driven by the web wind-up unit and the snubbing rolls at a ratio similar to that described for the snubbing rolls of FIG. 1. It should be also pointed out that snubbing rolls 33 and 34 can be located posterior to exit tractor 32 for the purpose of winding up the web under high tension following completion of the printing or other operation at print couple 25.

Figure 3:
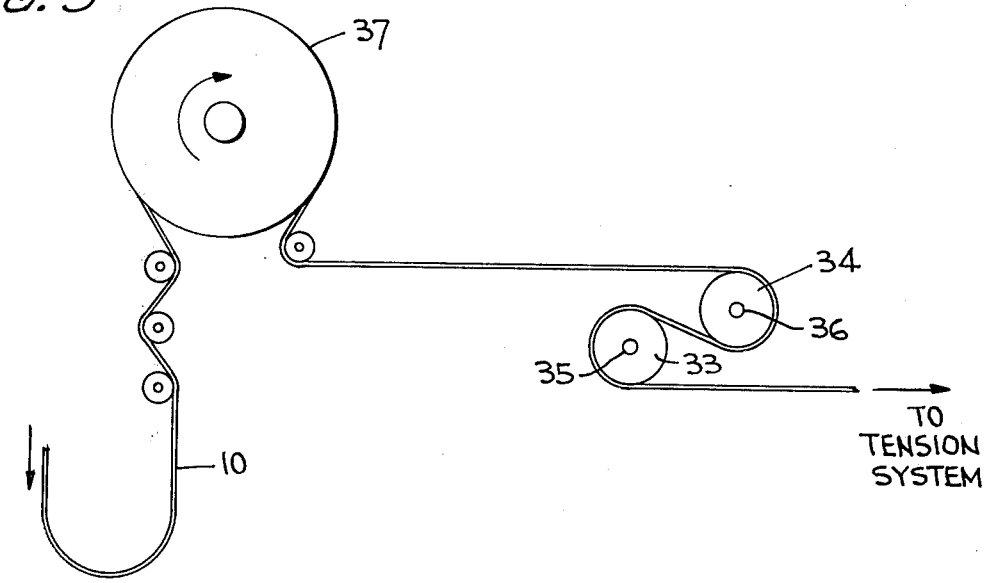
FIG. 3 is a schematic illustration similar to FIG. 2 except that a metering drum is used as the infeed web means.

The invention is not limited to a tractor infeed shown in FIGS. 1 and 2 at which the aforedescribed high web tension is isolated from the punch holes at such infeed. A metering drum 37 of the fixed-ratio variety may instead be used as the web infeed means, as shown in FIG. 3. Here again, the snubbing action of rolls 33 and 34 isolates the high web tension of the web, at the web rewind unit (not shown), from the low web tension required for the metering drum to effectively feed the web into the system.

In view of the foregoing, it can be seen that the relatively high web tension at a required station for the web (e.g., at the print couple, at the adhesive or other finishing station, at the perforating station, at the rewind unit, etc.) can be isolated from the low web tension required at the web infeed by using an underfed set of tension snubbing rolls between the infeed means and the high web tension system. When an operation or operations as that described with reference to FIG. 1 take place, a set of pull-up rolls is located posterior to the print couple between the impression cylinder and the exit tractor for isolating the high web tension from such exit tractor. The present tension control system accomplishes this isolation of web tension without any compromise to papers, inks or even print quality.

Obviously, many other modifications and variations of the invention are made possible in the light of the above teachings. It is therefore to be understood that within the scope of the appended claims the invention may be practiced otherwise than as specifically described.

What is claimed is:

1. In an apparatus operative on a continuous web, including web infeed and metering means for forwardly feeding and metering said web at a predetermined displacement rate, and web operational means located posterior to said web infeed and metering means which is capable of effecting a feeding of said web, wherein differential in web tension anterior and posterior to said web operational means can exceed the holding strength and elastic elongation error range desired by said web infeed and metering means and which can be of sufficient magnitude to result in corresponding positional realignment of said web and which can result in subsequent registrative length mismatch when multiple individual processed webs must be maintained in mutual assembly, the improvement comprising said web infeed and metering means feeding at a first web surface feed rate and at a first web tension level, said web operational means feeding said web at a second web surface feed rate not less than said first web surface feed rate and at any common reference tension level, web snubbing rolls located between said web infeed and metering means and said web operational means for controlling said web at a third roll surface feed rate which is less than said first or said second feed rates and at any said common reference tension level, the web tension thereby increasing incrementally from said web infeed and metering means to said web operational means, whereby said first web tension at said web infeed and metering means is isolated from the web tension present anterior to said web operational means so that desired metering accuracy at said first web tension level at said web infeed and metering means is maintained.

2. The apparatus according to claim 1, further including a web outfeed and metering means located posterior to said web operational means for feeding said web at a fourth web surface feed rate equal to said first web surface feed rate and at a third web tension level relatively lower than said reference tension, and web pull-up rolls located between said web at a roll surface feed rate which is greater than said any other of said feed rates, the web tension decreasing incrementally from said web operational means to said web outfeed and metering means, whereby said third web tension at said web outfeed and metering means is isolated from the web tension present posterior to said web operational means so that desired metering accuracy at said third web tension level at said web outfeed and metering means is maintained.

3. The apparatus according to claim 2, wherein said web infeed and outfeed means each comprises a web pin feed unit.

4. The apparatus according to claim 2, wherein said web operation means comprises a print couple of a rotary web-fed printing press.

5. The apparatus according to claim 1, wherein said infeed means comprises a web pin feed unit.

6. The apparatus according to claim 1, wherein said infeed means comprises a metering drum.

* * * * *